US011685156B2

(12) United States Patent
Inoue et al.

(10) Patent No.: US 11,685,156 B2
(45) Date of Patent: Jun. 27, 2023

(54) LIQUID DISCHARGE HEAD AND PRINTING APPARATUS PROVIDED WITH LIQUID DISCHARGE HEAD

(71) Applicant: BROTHER KOGYO KABUSHIKI KAISHA, Nagoya (JP)

(72) Inventors: Haru Inoue, Nagoya (JP); Wataru Naruse, Nagoya (JP); Hiroto Sugahara, Ama (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 64 days.

(21) Appl. No.: 17/191,811

(22) Filed: Mar. 4, 2021

(65) Prior Publication Data

US 2021/0300036 A1 Sep. 30, 2021

(30) Foreign Application Priority Data

Mar. 31, 2020 (JP) ..... 2020-063313

(51) Int. Cl.
*B41J 2/045* (2006.01)

(52) U.S. Cl.
CPC ..... *B41J 2/04588* (2013.01); *B41J 2/04541* (2013.01); *B41J 2/04581* (2013.01); *B41J 2/04596* (2013.01)

(58) Field of Classification Search
CPC ..... B41J 2/04596
See application file for complete search history.

(56) References Cited

U.S. PATENT DOCUMENTS

2002/0012017 A1* 1/2002 Yonekubo ..... B41J 2/04563 347/10
2008/0174627 A1* 7/2008 Kamiyama ..... B41J 2/04541 347/17

(Continued)

FOREIGN PATENT DOCUMENTS

EP 1 174 266 B1 11/2006
JP 2003080741 A * 3/2003

(Continued)

OTHER PUBLICATIONS

Extended European Search Report issued in corresponding European Patent Application No. 21161672.7, dated Aug. 10, 2021.

*Primary Examiner* — Shelby L Fidler
(74) *Attorney, Agent, or Firm* — Merchant & Gould P.C.

(57) ABSTRACT

A liquid discharge head includes: a channel substrate having a nozzle and a channel communicating with the nozzle; a driving element arranged on the channel substrate; and a driving signal generating circuit which generates a driving signal to drive the driving element. The driving signal includes a non-discharge driving signal by which the driving element is driven so that liquid in the channel is not discharged from the nozzle. The non-discharge driving signal includes at least one first slight-vibration waveform and at least one second slight-vibration waveform. The first slight-vibration waveform is a waveform by which the driving element is displaced by a first displacement amount. The second slight-vibration waveform is a waveform by which the driving element is displaced by a second displacement amount that is larger than the first displacement amount. The at least one second slight-vibration waveform follows after the at least one first slight-vibration waveform.

6 Claims, 10 Drawing Sheets

(56) References Cited

U.S. PATENT DOCUMENTS

| | | | | |
|---|---|---|---|---|
| 2012/0206521 | A1 | 8/2012 | Zhang | |
| 2012/0274689 | A1* | 11/2012 | Zhang | B41J 2/14274 347/10 |
| 2013/0063507 | A1* | 3/2013 | Sasaki | B41J 2/04593 347/11 |
| 2016/0176191 | A1* | 6/2016 | Kuramochi | B41J 2/04596 347/70 |
| 2016/0185105 | A1 | 6/2016 | Hasegawa | |
| 2017/0253030 | A1 | 9/2017 | Kumagai | |

FOREIGN PATENT DOCUMENTS

| | | |
|---|---|---|
| JP | 2012-166456 | 9/2012 |
| JP | 2017-154415 | 9/2017 |

* cited by examiner

LIQUID DISCHARGE HEAD AND PRINTING APPARATUS PROVIDED WITH LIQUID DISCHARGE HEAD

CROSS REFERENCE TO RELATED APPLICATION

The present application claims priority from Japanese Patent Application No. 2020-063313 filed on Mar. 31, 2020, the disclosure of which is incorporated herein by reference in its entirety.

BACKGROUND

Field of the Invention

The present disclosure relates to a liquid discharge head discharging liquid such as ink from nozzles, and a printing apparatus provided with the liquid discharge head.

Description of the Related Art

There is known a liquid discharge apparatus including piezoelectric elements, nozzles from which ink is discharged through deformation of the piezoelectric elements, and a driving signal generating section that generates driving signals to be applied to the piezoelectric elements (see, Japanese Patent Application Laid-open No. 2017-154415). In this liquid discharge apparatus, the driving signals include a slight-vibration waveform by which the piezoelectric elements vibrate slightly to discharge no ink from the nozzles, and a driving waveform by which the piezoelectric elements are deformed to discharge ink from the nozzles. Vibrating the piezoelectric elements slightly by the slight-vibration waveform causes the ink in the vicinity of the nozzles to vibrate slightly to an extent that no ink is discharged from the nozzles. This inhibits meniscuses from drying during a period during which no ink is discharged.

SUMMARY

However, a dispersion state of ink components locally changes in individual channels communicating with the respective nozzles, depending on how to vibrate the ink slightly in the vicinity of the nozzles, that is, depending on how to apply the slight-vibration waveform to the piezoelectric elements. This may affect printing quality after the ink in the vicinity of the nozzles is slightly vibrated.

An object of the present disclosure is to provide a liquid discharge head that heats ink in an individual channel to inhibit an increase in viscosity of the ink in the vicinity of a nozzle by causing a piezoelectric element to vibrate slightly, and that inhibits a dispersion state of the ink components in the individual channel from changing locally, and a printing apparatus including the liquid discharge head.

According to a first aspect of the present disclosure, there is provided a liquid discharge head, including:

a channel substrate having a nozzle and a channel communicating with the nozzle;

a driving element arranged on the channel substrate; and a driving signal generating circuit configured to generate a driving signal by which the driving element is driven, wherein the driving signal includes a non-discharge driving signal by which the driving element is driven so that liquid in the channel is not discharged from the nozzle, the non-discharge driving signal includes at least one first slight-vibration waveform and at least one second slight-vibration waveform, the first slight-vibration waveform is a waveform by which the driving element is displaced by a first displacement amount, the second slight-vibration waveform is a waveform by which the driving element is displaced by a second displacement amount that is larger than the first displacement amount, and the at least one second slight-vibration waveform follows after the at least one first slight-vibration waveform.

According to the first aspect of the present disclosure, the non-discharge driving signal includes at least one first slight-vibration waveform and at least one second slight-vibration waveform. Thus, the driving element can be driven without discharging the liquid from the nozzle by inputting the non-discharge driving signal to the driving element. That is, even during a period during which no liquid is discharged, the liquid in the channel can be heated by heat generated at the time of consecutively driving the driving element a plurality of times. This reduces the viscosity of the liquid, making it possible to smoothly start liquid discharge when the discharge driving signal is input. Further, in the non-discharge driving signal, at least one second slight-vibration waveform follows after the at least one first slight-vibration waveform. It is thus possible for the at least one second slight-vibration waveform to redisperse, in the liquid, part of the components of the liquid that is agglutinated at the position above the opening of the nozzle through the at least one first slight-vibration waveform. As a result, the ratio of components in the liquid discharged is substantially equal between a timing after the liquid discharge is started and a timing after a few liquid droplets are discharged, thus obtaining desired printing quality.

According to a second aspect of the present disclosure, there is provided a printing apparatus, including:

a conveyor configured to convey a recording medium in a first direction;

a plurality of liquid discharge heads arranged in a second direction intersecting with the first direction and configured to discharge liquid to the recording medium conveyed in the first direction; and a controller configured to control the plurality of liquid discharge heads and the conveyor, wherein each of the plurality of liquid discharge heads includes:

a channel substrate having a nozzle and a channel communicating with the nozzle;

a driving element arranged on the channel substrate; and a driving signal generating circuit configured to generate a driving signal by which the driving element is driven, the driving signal includes:

a non-discharge driving signal by which the driving element is driven so that the liquid in the channel is not discharged from the nozzle; and a discharge driving signal by which the driving element is driven so that the liquid in the channel is discharged from the nozzle, the non-discharge driving signal includes at least one first slight-vibration waveform and at least one second slight-vibration waveform, the first slight-vibration waveform is a waveform by which the driving element is displaced by a first displacement amount, the second slight-vibration waveform is a waveform by which the driving element is displaced by a second displacement amount larger than the first displacement amount, the discharge driving signal includes at least one discharge waveform, the discharge waveform is a waveform in which voltage changes from a first voltage to a second voltage higher than the first voltage and then changes from the second voltage to the first voltage, thereby displacing the driving element by a third displacement amount larger than the second displacement amount, in each of the first slight-vibration waveform and the second slight-vibration waveform, voltage changes from the first voltage toward the second voltage, and then starts to change toward the first voltage before reaching the second voltage, the at least one second slight-vibration waveform follows after the at least one first slight-vibration waveform, the conveyor includes a conveyance roller configured to convey the recording medium and a conveyance motor configured to drive the conveyance roller, the controller is configured to control the conveyance motor to increase conveyance velocity of the recording medium from a first velocity to a second velocity, and to maintain the conveyance velocity at the second velocity, and the controller is configured to control the driving signal generating circuit to input the non-discharge driving signal to the driving element, after the conveyance velocity changes from the first velocity and before the conveyance velocity reaches the second velocity, and the controller is configured to control the driving signal generating circuit to input the discharge driving signal to the driving element, after the conveyance velocity reaches the second velocity.

The second aspect of the present disclosure can also obtain effects similar to the first aspect.

DESCRIPTION OF THE EMBODIMENTS

Referring to FIGS. 1 to 9, a printing apparatus according to an embodiment of the present disclosure is explained below.

Figure 1:
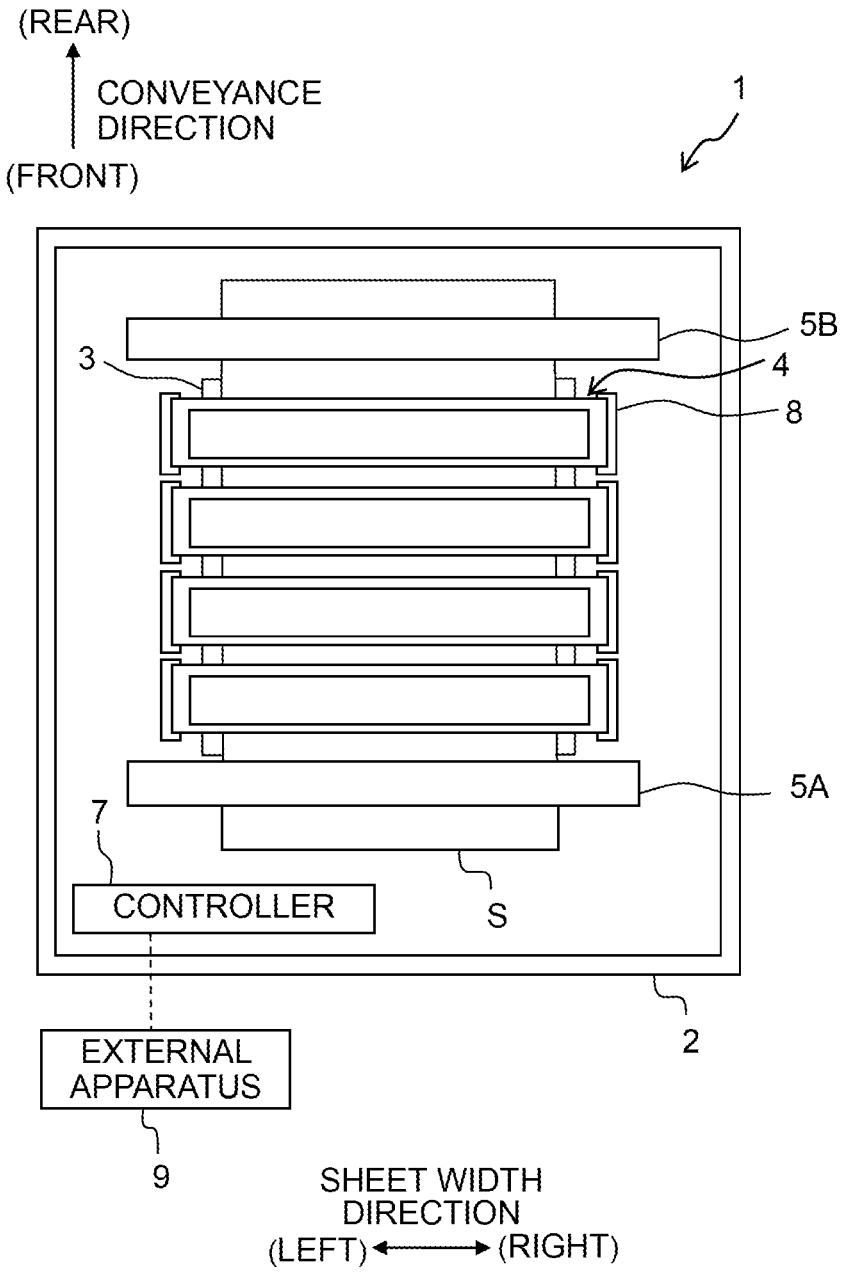
FIG. 1 is a plan view of an example of a main configuration of a printing apparatus according to this embodiment.

In FIG. 1, an upstream side in a conveyance direction of a sheet S is defined as a front side of a printing apparatus 1, and a downstream side in the conveyance direction is defined as a rear side of the printing apparatus 1. Further, a direction parallel to a surface on which the sheet S is conveyed (a surface parallel to the sheet surface of FIG. 1) and orthogonal to the conveyance direction is defined as a sheet width direction. A left side in FIG. 1 is a left side of the printing apparatus 1, and a right side in FIG. 1 is a right side of the printing apparatus 1. A direction orthogonal to a conveyance surface of the sheet S (a direction orthogonal to the surface of FIG. 1) is defined as an up-down direction of the printing apparatus 1. In FIG. 1, a fore side (front side) of the sheet surface of FIG. 1 is defined as up (upper side), and a far side (the other side) of the sheet surface of FIG. 1 is defined as down (lower side). In the following, explanation is made by appropriately using the front, rear, left, right, up (upper), and down (lower) directions. The conveyance direction is an exemplary "first direction", and the sheet width direction is an exemplary "second direction".

As defined in FIG. 1. the printing apparatus 1 includes a casing 2, a platen 3, four line heads 4, two conveyance rollers 5A, 5B, and a controller 7.

The platen 3 is placed flatly in the casing 2. The sheet S such as paper (an exemplary recording medium) is placed on an upper surface of the platen 3. The four line heads 4 are provided above the platen 3 such that they are arranged in a front-rear direction. The conveyance roller 5A is disposed on the front side of the platen 3 and the conveyance roller 5B is disposed on the rear side of the platen 3. The two conveyance rollers 5A and 5B are driven by a motor (not depicted) to convey the sheet S on the platen 3 rearward. Although the printing apparatus 1 includes the four line heads 4 in this embodiment, the number of the line leads 4 is not limited to four.

Figure 3:
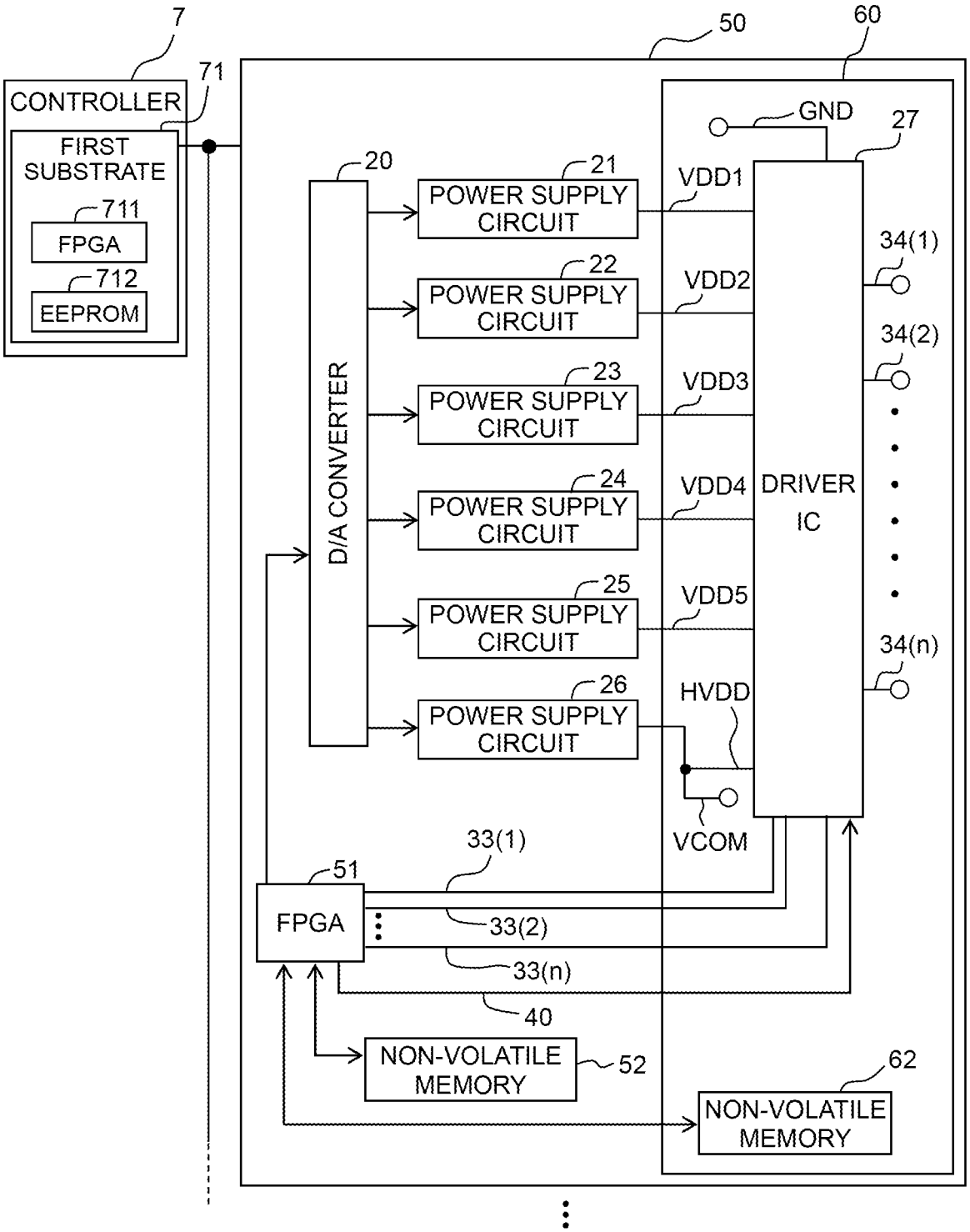
FIG. 3 is a block diagram of an example of a configuration including a second substrate that is provided in the head and a flexible circuit board that is connected to the second substrate of this embodiment.

As depicted in FIG. 3, the controller 7 includes a first substrate 71. The first substrate 71 includes a Field Programmable Gate Array (FPGA) 771, a Read Only Memory (ROM, not depicted in the drawings), a Random Access Memory (RAM, not depicted in the drawings), an Electrically Erasable Programmable Read-Only Memory (EEPROM) 712, and the like. The controller 7 interacts or intercommunicates with an external apparatus 9, such as a personal computer. When the controller 7 receives an instruction from the external apparatus 9 or an operation section (not depicted) provided for the printing apparatus 1, the controller 7 controls the operation of the line heads 4 and the operation of the conveyance rollers 5A, 5B in accordance with a program(s) stored in the ROM. A Central Processing Unit (CPU) or a Microprocessor Unit (MPU) may be used instead of the FPGA 711.

For example, the controller 7 controls the motor, which drives the conveyance rollers 5A and 5B, to cause the conveyance rollers 5A and 5B to convey the sheet S in the conveyance direction. Further, the controller 7 controls each line head 4 to discharge ink to the sheet S. Accordingly, an image is printed on the sheet S. The sheet S may be a roll-shaped sheet including a supply roll that has an upstream end in the conveyance direction and a recovery roll that has a downstream end in the conveyance direction. In this case, the supply roll may be attached to the conveyance roller 5A at the upstream side in the conveyance direction. The recovery roll may be attached to the conveyance roller 5B at the downstream side in the conveyance direction. Or, the sheet S may be a roll-shaped sheet only including the supply roll that has the upstream end in the conveyance direction. In this case, the supply roll may be attached to the conveyance roller 5A at the upstream side in the conveyance direction. The conveyance rollers 5A, 5B and the motor driving the conveyance rollers 5A, 5B are an exemplary conveyor.

The casing 2 includes four head holding portions 8 corresponding to the four line heads 4. The head holding portions 8 are arranged above the platen 3 in a position between the conveyance rollers 5A and 5B. The head holding portions 8 are arranged in the front-rear direction. Each of the head holding portions 8 holds the corresponding one of the ink-jet heads 4.

The four line heads 4 respectively discharge inks of four colors of cyan (C), magenta (M), yellow (Y), and black (K). Each of the inks is supplied from the corresponding one of ink tanks (not depicted) to the corresponding one of the line heads 4.

Figure 2:
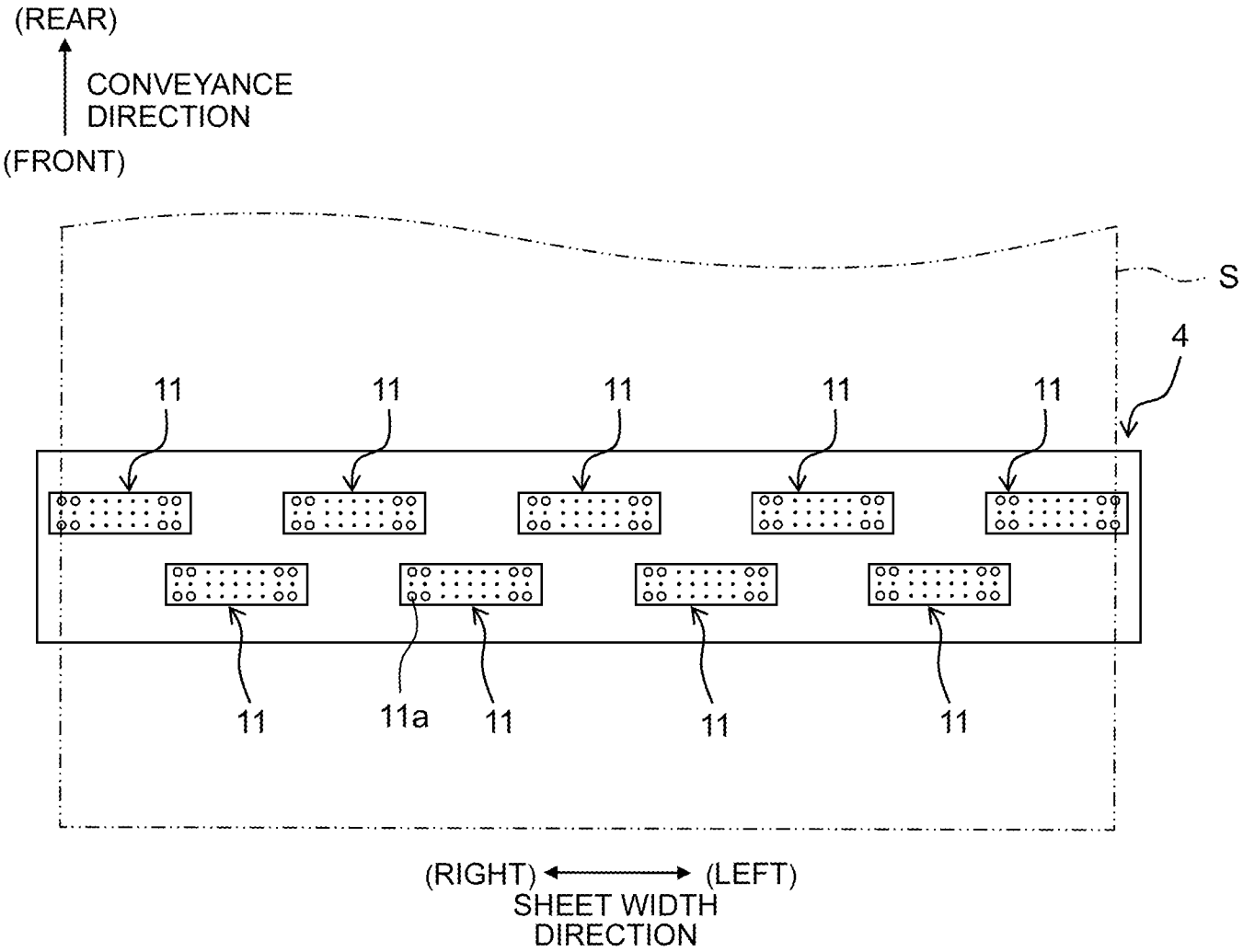
FIG. 2 is a bottom view of an exemplary head according to this embodiment.

As depicted in FIG. 2, each line head 4 of this embodiment includes nine heads 11 (an exemplary liquid discharge head). The nine heads 11 are arranged zigzag in the sheet width direction to form two rows. Since one color of ink is supplied to one line head 4, said one color of ink is discharged from the nine heads 11 included in said one line head 4. In this embodiment, the line head 4 includes the nine heads 11. The number of the heads 11, however, is not limited to nine.

In a bottom surface of each head 11 in this embodiment, 1680 nozzles 11*a* are opened. The 1680 nozzles 11*a* form nozzle rows arranged in the sheet width direction. Each nozzle row is formed by nozzles 11*a* arranged in the conveyance direction. Although each head 11 includes the 1680 nozzles 11*a* in this embodiment, the number of nozzles 11*a* is not limited to 1680.

Each head 11 includes the same number of driving elements 111 (described below) as the nozzles 11*a*, a second substrate 50, and a flexible circuit board 60. The printing apparatus 1 of this embodiment includes the four line heads 4. Each line head 4 includes the nine heads 11. The printing apparatus 1 thus includes thirty-six heads 11. Accordingly, the number of the second substrates 50 is thirty-six, and the number of flexible circuit boards 60 connected to the second substrates 50 is thirty-six. As depicted in FIG. 3, the first substrate 71 of the controller 7 is connected to the thirty-six second substrates 50. For convenience, only one second substrate 50 and one flexible circuit board 60 are depicted in FIG. 3.

The second substrate 50 includes: a FPGA 51, a non-volatile memory 52 such as an EEPROM, a D/A converter 20, power supply circuits 21 to 26, and the like. Although the second substrate 50 includes the six power supply circuits 21 to 26 in this embodiment, the number of the power supply circuits is not limited to six. The flexible circuit board 60 includes a non-volatile memory 62 such as an EEPROM, a driver IC 27, and the like.

Under the control of the FPGA 711 provided in the first substrate 71, the FPGA 51 outputs, to the D/A converter 20, a digital setting signal for setting an output voltage of each of the power supply circuits 21 to 26.

The D/A converter 20 converts the digital setting signal output from the FPGA 51 into an analog setting signal, and then outputs it to each of the power supply circuits 21 to 26.

Each of the power supply circuits 21 to 26 may be configured as a DC/DC converter made using electronic components, such as a FET, an inductor, a resistance, and an electrolytic capacitor. Each of the power supply circuits 21 to 26 outputs, to the driver IC 27, the output voltage designated by the setting signal. All of the power supply circuits 21 to 26 are set to have different output voltages in this embodiment.

The power supply circuit 21 is connected to the driver IC 27 via a trace VDD1. The power supply circuit 22 is connected to the driver IC 27 via a trace VDD2. The power supply circuit 23 is connected to the driver IC 27 via a trace VDD3. The power supply circuit 24 is connected to the driver IC 27 via a trace VDD4. The power supply circuit 25 is connected to the driver IC 27 via a trace VDD5. The power supply circuit 26 is connected to the driver IC 27 via a trace HVDD. The power supply circuit 26 is connected to each driving element 111 described below via a trace VCOM. The traces HVDD and VCOM are branched from an intermediate portion of a trace that is pulled out from the power supply circuit 26.

The power supply circuits 21 to 26 are respectively connected to driving signal generating circuits 30(1) to 30(*n*) in the driver IC 27 (n is a natural number equal to or greater than 2, and n is equal to the number of the driving elements 111 in the head unit 11 (i.e., 1680) in this embodiment).

The driving signal generating circuits 30(1) to 30(*n*) are provided corresponding to n pieces of the driving element 111 in each head 11. That is, the driving signal generating circuits 30(1) to 30(*n*) are provided corresponding to n pieces of the nozzle 11*a* in each head 11. The driver IC 27 is connected to n pieces of signal line 34(1) to 34(*n*). The driver IC 27 is connected to n pieces of the driving element 111 via n pieces of the signal line 34(1) to 34(*n*). Each signal line 34 is connected to an individual electrode of the corresponding driving element 111.

The driver IC 27 includes n pieces of selector 90(1) to 90(*n*) provided corresponding to n pieces of the driving element 111. The respective selectors 90 are components of hardware that is configured, for example, by a plurality of FETs formed in the driver IC 27.

The power supply circuit 26 can be used as a power supply voltage for the VCOM of the driving elements 111, or can be used as a high-side back gate voltage (HVDD) of PMOS transistors 311 to 315 described below.

The driver IC 27 is connected to the FPGA 51 via a control line 40 and n pieces of control line 33(1) to 33(*n*). The control lines 33(1) to 33(*n*) are provided corresponding to n pieces of the driving signal generating circuit 30(1) to 30(*n*). A signal for controlling the FET provided for each driving signal generating circuit 30 is transmitted to each control line 33. The driving signal generating circuit 30 generates a driving signal for driving the driving element 111 in accordance with the above signal, and the driving signal generated is output to the driving element 111 via the signal line 34.

A control signal for controlling n pieces of the selector 90(1) to 90(*n*) in the driver IC 27 is transmitted to the control line 40. The FPGA 51 controls n pieces of the selector 90(1) to 90(*n*) and selects a power supply circuit for generating the driving signal to be output to each signal line 34.

Figure 4:
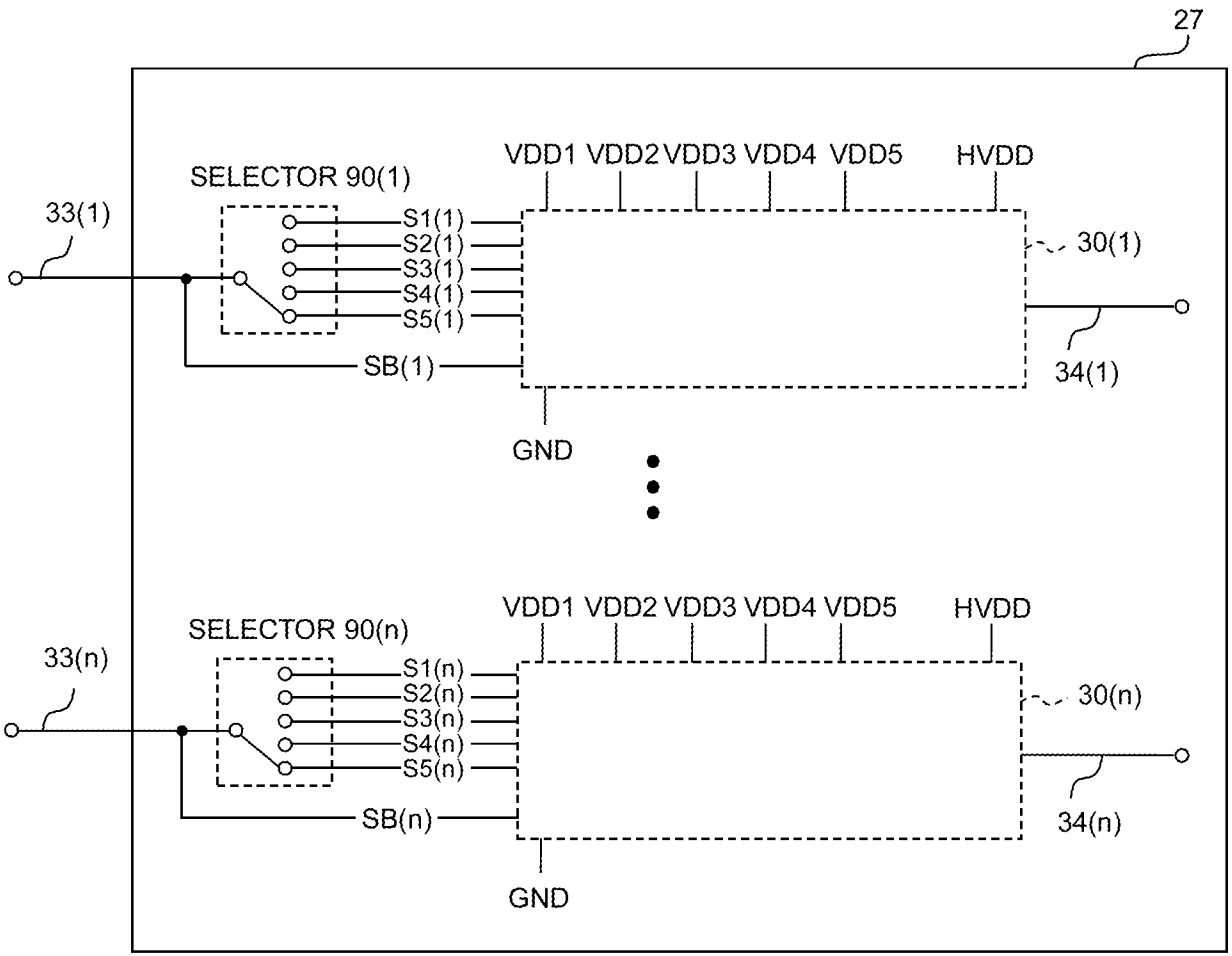
FIG. 4 depicts an example of a circuit configuration provided in a driver IC.

Referring to FIG. 4, an exemplary configuration of the circuit in the driver IC 27 is explained below. As depicted in FIG. 4, the driver IC 27 includes n pieces of the driving signal generating circuit 30(1) to 30(*n*), and n pieces of the selector 90(1) to 90(*n*) provided corresponding to the respective driving signal generating circuits 30(1) to 30(*n*).

The driver IC 27 includes n pieces of the above circuit configuration, the number of which is the same as the number of nozzles. The n pieces of the circuit configuration have the same configuration. Thus, a circuit configuration disposed between the control line 33(1) and the signal line 34(1) is explained below, as a representative. In the driver IC 27, the selector 90(1) and the driving signal generating circuit 30(1) are formed between the control line 33(1) and the signal line 34(1).

The control line 33(1) from the FPGA 51 is connected to the selector 90(1). The control line 33(1) is branched from an intermediate portion of a route connecting the FPGA 51 and the selector 90(1), and a control line SB(1) branched from the intermediate portion of the control line 33(1) is connected to the driving signal generating circuit 30(1).

The selector 90(1) is connected to the driving signal generating circuit 30(1) via five control lines S1(1), S2(1), S3(1), S4(1), and S5(1). The selector 90(1) selects any one of the five control lines S1(1), S2(1), S3(1), S4(1), and S5(1) in accordance with an instruction from the FPGA 51, and connects the selected line to the control line 33(1).

The driving signal generating circuit 30(1) is connected to five traces connected to the traces VDD1 to VDD5, a trace connected to the trace HVDD, and a trace connected to a trace GND.

Figure 5:
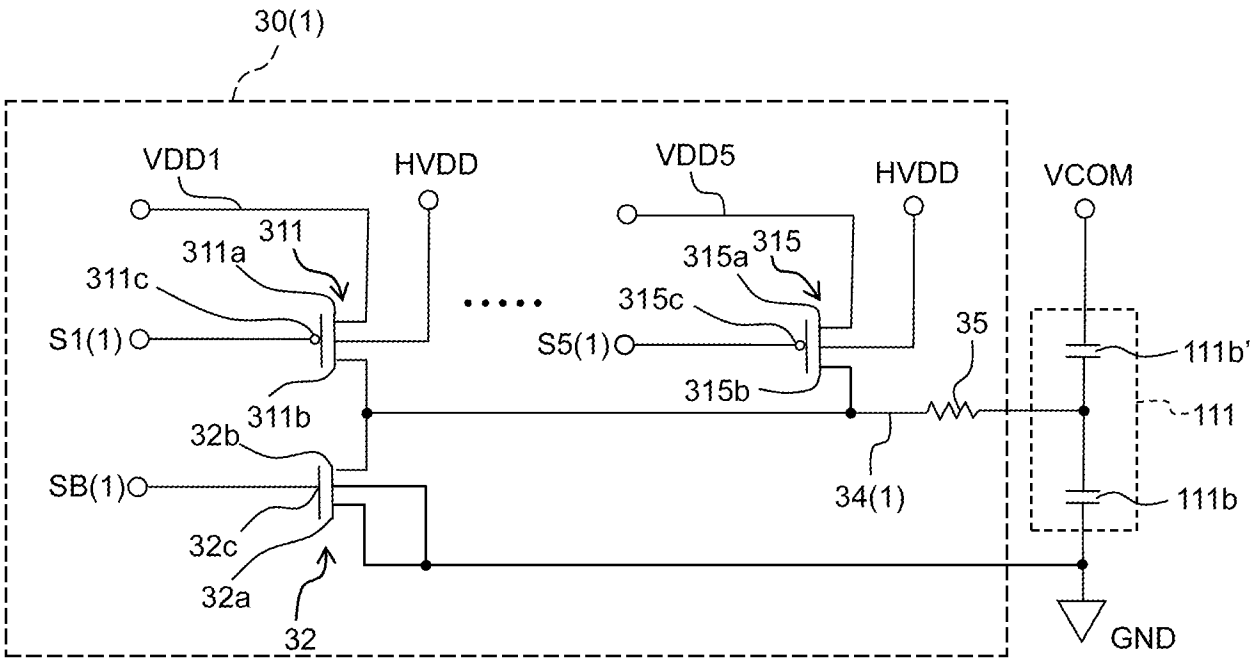
FIG. 5 is a circuit diagram depicting an exemplary configuration of a driving signal generating circuit provided in the head of this embodiment.

Referring to FIG. 5, an exemplary circuit configuration of the driving signal generating circuits 30(1) to 30(*n*) provided for the head 11 according to this embodiment is explained below. Since the driving signal generating circuits 30(1) to 30(*n*) have the same configuration, only the driving signal generating circuit 30(1) is explained below. The driving signal generating circuit 30(1) includes five P-type Metal Oxide Semiconductor (PMOS) transistors 311 to 315 (only two transistors are depicted in FIG. 5), a N-type Metal Oxide Semiconductor (NMOS) transistor 32, a resistance 35, and the like. The driving signal generating circuit 30(1) is connected to the individual electrode of the driving element 111 via the signal line 34(1).

Each of the driving elements 111 of this embodiment corresponds to one of the pressure chambers. The driving element 111 is a piezoelectric element including a first active portion interposed between the individual electrode and a first constant potential electrode and a second active portion interposed between the individual electrode and a second constant potential electrode. The driving electrode 111 thus includes a capacitor 111*b* and a capacitor 111*b*'.

Five source terminals 311*a* to 315*a* of the PMOS transistors 311 to 315 are respectively connected to the traces VDD1 to VDD5. The source terminal 32*a* of the NMOS transistor 32 is connected to the ground. That is, the PMOS transistor 311 is connected to the power supply circuit 21 via the trace VDD1. The PMOS transistor 312 is connected to the power supply circuit 22 via the trace VDD2. The PMOS transistor 313 is connected to the power supply circuit 23 via the trace VDD3. The PMOS transistor 314 is connected to the power supply circuit 24 via the trace VDD4. The PMOS transistor 315 is connected to the power supply circuit 25 via the trace VDD5.

The control line S1(1) is connected to a gate terminal 311*c* of the PMOS transistor 311. The control line S2(1) is connected to a gate terminal 312*c* of the PMOS transistor 312. The control line S3(1) is connected to a gate terminal 313*c* of the PMOS transistor 313. The control line S4(1) is connected to a gate terminal 314*c* of the PMOS transistor 314. The control line S5(1) is connected to a gate terminal 315*c* of the PMOS transistor 315. The control line SB(1) is connected to a gate terminal 32*c* of the NMOS transistor 32.

Drain terminals 311*b* to 315*b* of the five PMOS transistors 311 to 315 are connected to a first end of the resistance 35. A drain terminal 32*b* of the NMOS transistor 32 is connected to the first end of the resistance 35. A second end of the resistance 35 is connected to the individual electrode of the driving element 111 (a second end of the capacitor 111*b*' and a first end of the capacitor 111*b*). The first constant potential electrode of the driving element 111 (a first end of the capacitor 111*b*') is connected to the VCOM, and the second constant potential electrode of the driving element 111 (a second end of the capacitor 111*b*) is connected to the ground.

When the FPGA 51 outputs a low-level signal (L signal) to the control line 33(1), any one of the PMOS transistors 311 to 315 connected to the signal line selected by the selector 90(1) becomes an on state. The capacitor 111*b* is charged with the voltage supplied from any one of the power supply circuits 21 to 25, and the capacitor 111*b*' is discharged. When the FPGA 51 outputs a high-level signal (H signal) to the control line 33(1), the NMOS transistor 32 becomes an on state. The capacitor 111*b*' is charged with the voltage output from any one of the power supply circuits 21 to 25, and the capacitor 111*b* is discharged. The driving element 111 is deformed by alternatingly charging and discharging each of the capacitors 111*b* and 111*b*'.

That is, the driving signal for driving the driving element 111 is output to the control line 34(1). The selector 90(1) selects any one of the five control lines S1(1) to S5(1) as the control line, which allows any one of the five power supply circuits 21 to 25 to be selected as the power supply circuit for generating the driving signal.

Figure 6:
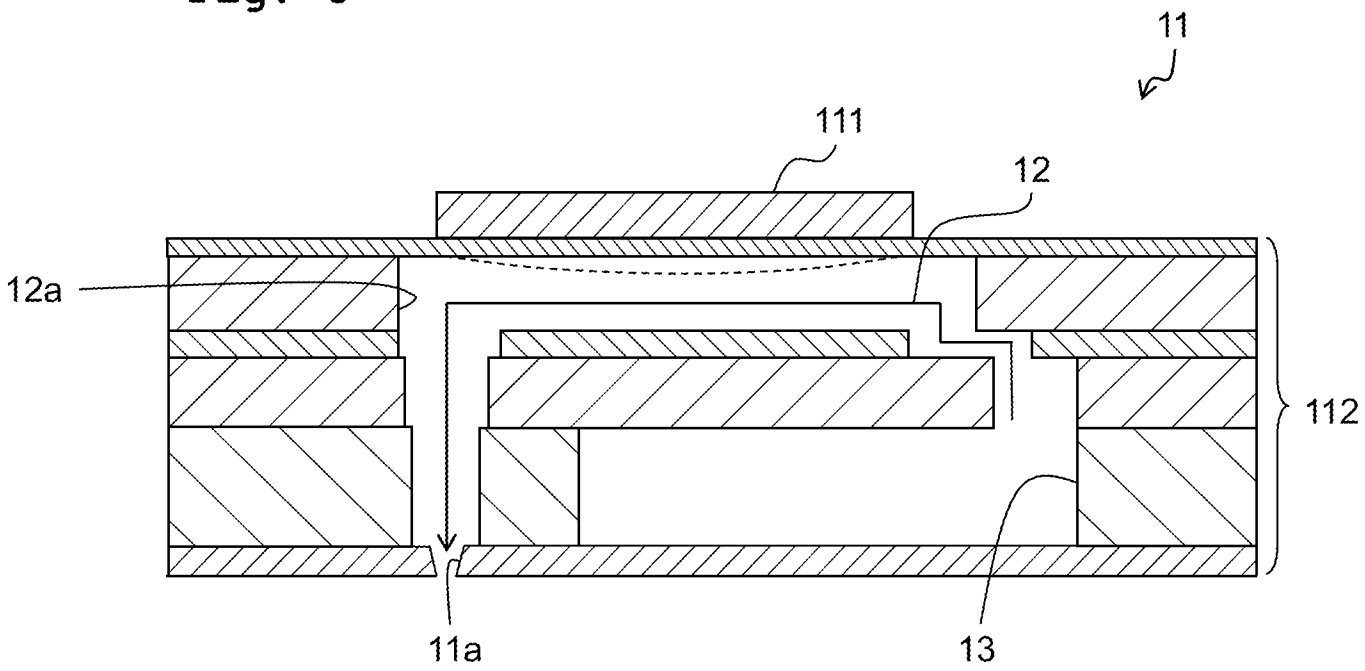
FIG. 6 is a cross-sectional view of an individual channel formed in the head according to this embodiment.

Here, a channel substrate 112 forming each head 11 is explained. The channel substrate 112 is formed with the nozzles 11*a*, individual channels 12 communicating with the respective nozzles 11*a*, and a common channel 13 communicating with the individual channels 12. The driving elements 111 are arranged in the channel substrate 112 such that the driving elements 111 correspond to the respective individual channels 12. As depicted in FIG. 6, each individual channel 12 includes a pressure chamber 12*a*, and each driving element 111 is disposed to face the pressure chamber 12*a*. Ink is supplied from an ink supply section (not depicted in the drawings) to the common channel 13 via an ink supply opening provided in the channel substrate 112. Ink supplied to the common channel 13 is supplied to each individual channel 12.

When the driving element 111 is deformed as described above, the pressure chamber 12*a* facing the driving element 111 is deformed as indicated by a broken line in FIG. 6. This increases internal pressure of the pressure chamber 12*a*, thus discharging ink from the nozzle 11*a*. When the driving element 111 is recovered from the deformation, the deformation of the pressure chamber 12*a* is recovered as indicated by a solid line in FIG. 6. This recovers the internal pressure of the pressure chamber 12*a*, which allows ink to flow from the common channel 13 to the individual channel 12. Repeating the deformation and the recovery of the driving element 111 as descried above consecutively discharges ink from the corresponding nozzle 11*a*.

Figure 7A:
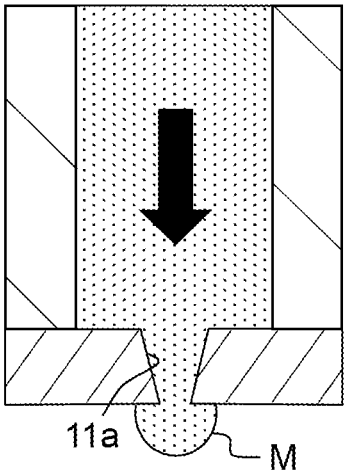
FIGS. 7A to 7E each depict vibration of meniscus of ink.
Figure 7B:
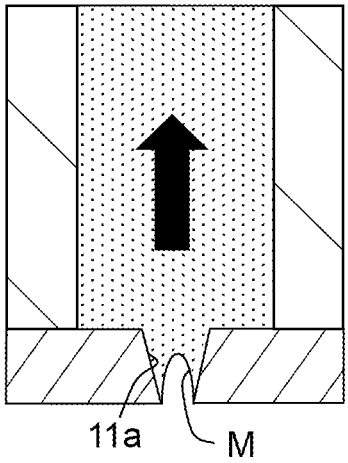
Figure 7C:
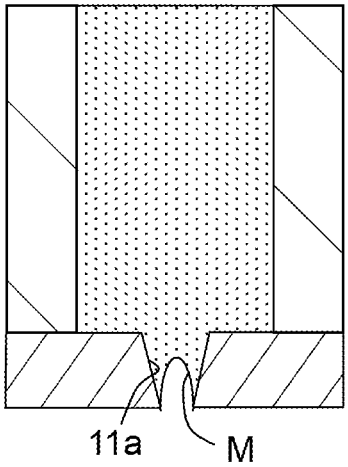
Figure 7D:
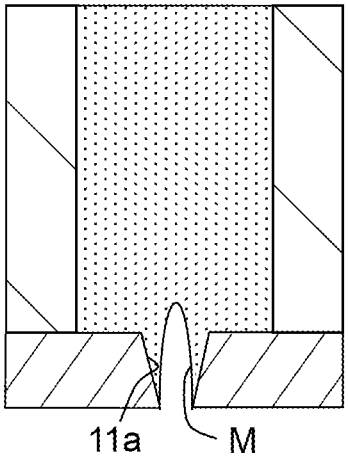
Figure 7E:
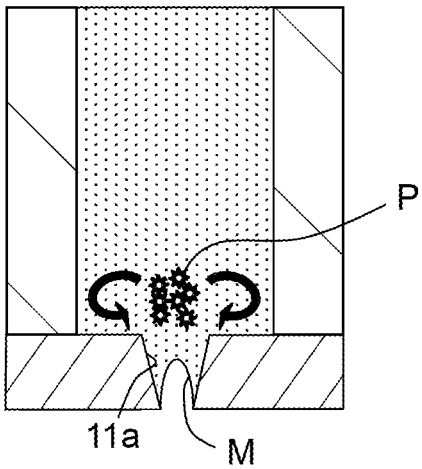

When the displacement amount of the driving element 111 at the time of deformation is insufficient, as depicted in FIG. 7A, a meniscus M of ink swells toward the outside of the nozzle 11*a*, but no ink is discharged from the nozzle 11*a*. When the driving element 111 in this state is recovered, as depicted in FIG. 7B, the meniscus M of ink is deformed (becomes convex) toward the inside of the nozzle 11*a*. As described above, the driving element 111 is deformed to an extent that no ink is discharged from the nozzle 11*a*, thereby vibrating the meniscus M of ink. This inhibits the meniscus M of from drying. A maximum displacement amount of the meniscus M of ink changes depending on a maximum displacement amount of the driving element 111. That is, as depicted in FIGS. 7C and 7D, the meniscus M of ink is deformed (becomes convex) toward the inside of the nozzle 11*a* more greatly as the maximum displacement amount of the driving element 111 is larger.

When the deformation and the recovery of the driving element 111 are repeated in a state where a constant maximum displacement amount thereof is maintained, vibration of the meniscus M of ink is repeated in a state where the constant maximum displacement amount thereof is maintained. In this situation, a vortex flow (swirling current) is caused in the vicinity of the nozzle 11*a* in the individual channel 12 as indicated by thick line arrows in FIG. 7E. The vortex flow changes a dispersion state of ink in the vicinity of the nozzle 11*a*. For example, when ink is a pigment ink, the vortex flow causes a pigment P dispersed in ink to agglutinate or coagulate at a position above an opening of the nozzle 11*a*. When ink is discharged consecutively from the nozzle 11*a* in this state, desired printing quality may not be obtained, because the ratio of the pigment P in the ink discharged is different between a timing after ink discharge is started and a timing after a few ink droplets are discharged.

In view of the above, in this embodiment, at the time of non-discharge of ink, the driving element 111 is consecutively driven a plurality of times while a first displacement amount of the driving element 111 is maintained with no ink being discharged from the nozzle 11*a*. Then, the driving element 111 is driven to be displaced by a second displacement amount larger than the first displacement amount. Driving the driving element 111 to be displaced by the second displacement amount makes the maximum displacement amount of the meniscus M of ink larger than a case where the driving element 111 is driven to be displaced by the first displacement amount. Thus, the meniscus M of ink having the large maximum displacement amount can redisperse part of the components of ink, which is agglutinated at the position above the opening of the nozzle 11*a*, by driving the driving element 111 to be displaced by the first displacement amount. As a result, the ratio of components in the ink discharged is substantially equal between the timing after ink discharge is started and the timing after a few ink droplets are discharged, thus obtaining desired printing quality.

Figure 11:
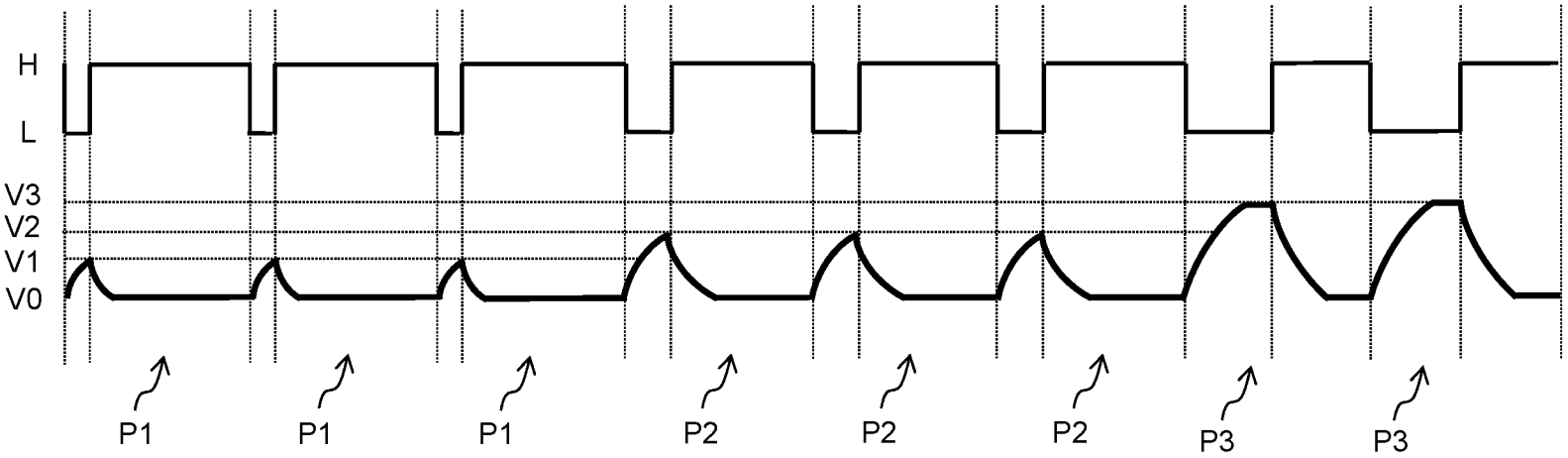
FIG. 11 depicts an example of the driving signal including the non-discharge driving signal and the discharge driving signal.

Next, driving waveforms included in the driving signals generated by the driving signal generation circuit 30 are explained. As depicted in FIG. 11, the driving signals include a non-discharge driving signal by which the driving element 111 is driven so that ink in the individual channel 12 is not discharged from the nozzle 11*a*, and a discharge driving signal by which the driving element 111 is driven so that ink in the individual channel 12 is discharged from the nozzle 11*a*. The non-discharge driving signal includes at least one first slight-vibration waveform P1 and at least one second slight-vibration waveform P2. The discharge driving signal includes at least one discharge waveform P3. The first slight-vibration waveform P1 is a waveform by which the driving element 111 is displaced by the first displacement amount. The second slight-vibration waveform P2 is a waveform by which the driving element 111 is displaced by the second displacement amount larger than the first displacement amount. The discharge waveform P3 is a waveform by which the driving element 111 is displaced by a third displacement amount larger than the second displacement amount.

Figure 8A:
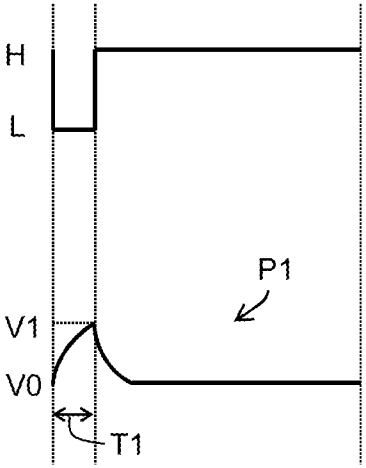
FIG. 8A depicts an example of a first slight-vibration waveform included in a non-discharge driving signal according to this embodiment.
Figure 8B:
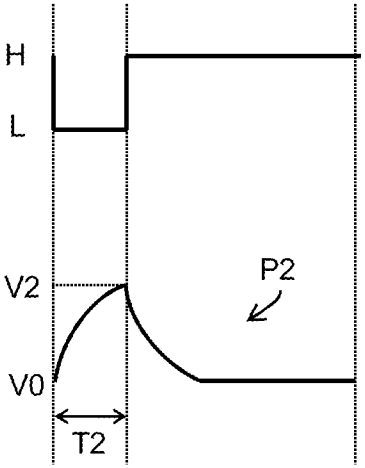
FIG. 8B depicts an example of a second slight-vibration waveform included in the non-discharge driving signal according to this embodiment.
Figure 8C:
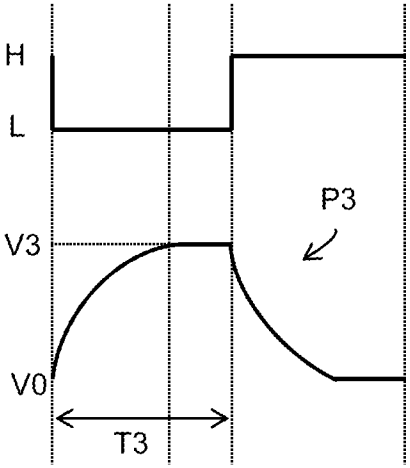
FIG. 8C depicts an example of a discharge waveform included in a discharge driving signal according to this embodiment.

When the first slight-vibration waveform P1 is generated, as depicted in FIG. 8A, the FPGA 51 switches the low-level signal (L) to the high-level signal (H) after a time T1 has elapsed since the low-level signal was input. Thus, the first slight-vibration waveform P1 rises from a voltage V0, and falls to the voltage V0 after reaching a voltage V1 (an example of a third voltage). When the second slight-vibration waveform P2 is generated, as depicted in FIG. 8B, the FPGA 51 switches the low-level signal to the high-level signal after a time T2 has elapsed since the low-level signal was input. Thus, the second slight-vibration waveform P2 rises from the voltage V0, and falls to the voltage V0 after reaching a voltage V2 (an example of a fourth voltage) larger than the voltage V1. When the discharge waveform P3 is generated, as depicted in FIG. 8C, the FPGA 51 switches the low-level signal to the high-level signal after a time T3 has elapsed since the low-level signal was input. Thus, the discharge waveform P3 rises from the voltage V0 (an example of a first voltage) to a voltage V3 (an example of a second voltage) larger than the voltage V2, and falls to the voltage V0 after maintaining the voltage V3 for a certain time. That is, each of the first slight-vibration waveform P1 and the second slight-vibration waveform P2 is a waveform that starts to fall toward the voltage V0, after the change from the voltage V0 toward the voltage V3 is started and before the voltage reaches the voltage V3.

The time T1 elapsing, at the time of generating the first slight-vibration waveform P1, after the low-level signal is input before the low-level signal is switched to the high-level signal is shorter than the time T2 elapsing, at the time of generating the second slight-vibration waveform P2, after the low-level signal is input before the low-level signal is switched to the high-level signal. The time T2 elapsing, at the time of generating the second slight-vibration waveform P2, after the low-level signal is input before the low-level signal is switched to the high-level signal is shorter than the time T3 elapsing, at the time of generating the discharge waveform P3, after the low-level signal is input before the low-level signal is switched to the high-level signal.

Figure 9:
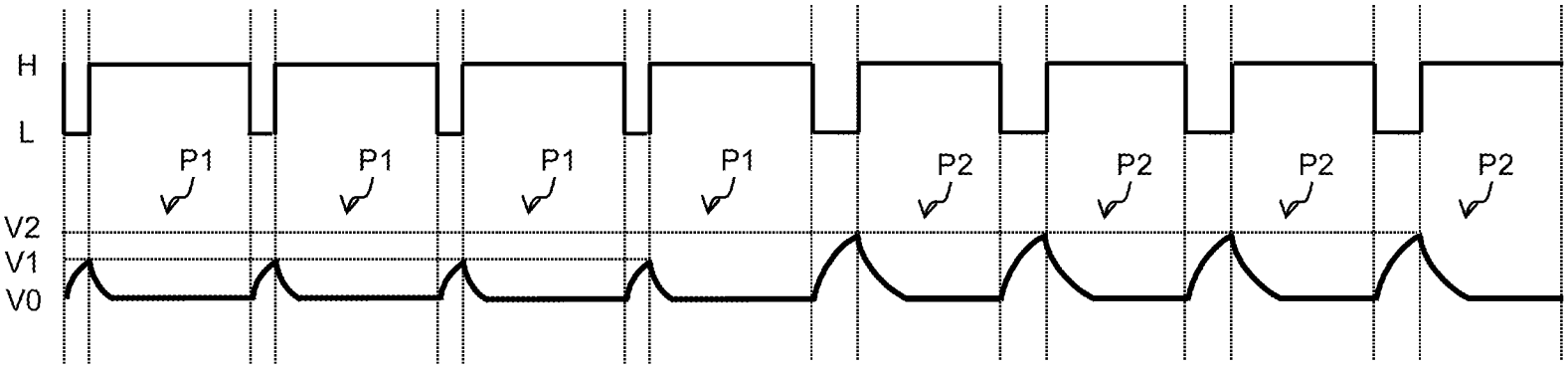
FIG. 9 depicts an example of the non-discharge driving signal according to this embodiment.

As described above, the non-discharge driving signal in this embodiment includes at least one first slight-vibration waveform P1 and at least one second slight-vibration waveform P2. As depicted in FIG. 9, at least one second slight-vibration waveform P2 follows after at least one first slight-vibration waveform P1. In other words, the discharge waveform P3 is not included between at least one first slight-vibration waveform P1 and at least one slight-vibration waveform P2. As depicted in FIG. 9, when the non-discharge driving signal includes a plurality of first slight-vibration waveforms P1, the first slight-vibration waveforms P1 are consecutive and the second slight-vibration waveform P2 is not between the first slight-vibration waveforms P1. As depicted in FIG. 9, when the non-discharge driving signal includes a plurality of second slight-vibration waveforms P2, the second slight-vibration waveforms P2 are consecutive and the first slight-vibration waveform P1 is not between the second slight-vibration waveforms P2.

In this embodiment, the non-discharge driving signal is input to the driving element 111 mainly before printing is started. Specifically, the controller 7 controls a conveyance motor (not depicted) for rotating the conveyance rollers 5A and 5B to increase the conveyance velocity of the sheet S from 0 m/s (an example of a first velocity) to a predefined velocity (an example of a second velocity). Then, the conveyance velocity of the sheet S is maintained at the predefined velocity. The controller 7 inputs the non-discharge driving signal to the driving element 111 by controlling the driving signal generation circuit 30 before the conveyance velocity changes from 0 m/s to the predefined velocity. After the conveyance velocity reaches the predefined velocity, the controller 7 controls the driving signal generation circuit 30 to input the discharge driving signal to the driving element 111. That is, after the conveyance rollers 5A and 5B start the conveyance of the sheet S and before the first discharge driving signal is input to the driving element 111, the non-discharge driving signal is input to the driving element 111. Here, a certain time during which the non-discharge driving signal is input from the driving signal generation circuit 30 to the driving element 111 is different from an interval between signals input to the controller 7 from a sensor detecting the conveyance velocity of the sheet S (not depicted). That is, the non-discharge driving signal input from the driving signal generation circuit 30 to the driving element 111 within the certain time is asynchronous to the signal input to the controller 7 from the sensor detecting the conveyance velocity of the sheet S. It is thus possible to input a necessary number of non-discharge driving signals to the driving element 11 at an appropriate timing before printing is started, and to vibrate the meniscus M of ink while heating ink in the individual channel 12.

In this embodiment, the non-discharge driving signal includes at least one first slight-vibration waveform P1 and at least one second slight-vibration waveform P2. The first slight-vibration waveform P1 is the waveform by which the driving element 111 is displaced by the first displacement amount so that no ink is discharged from the nozzle 11*a*. The second slight-vibration waveform P2 is the waveform by which the driving element 111 is displaced by the second displacement amount so that no ink is discharged from the nozzle 11*a*. The driving element 111 can thus be driven so that no ink is discharged from the nozzle 11*a* by inputting the non-discharge driving signal to the driving element 111. Accordingly, ink in the individual channel 12 can be heated by the heat generated when the driving element 111 is consecutively driven a plurality of times even during a period during which no ink is discharged. This reduces the viscosity of ink, making it possible to smoothly start ink discharge when the discharge driving signal is input.

When the non-discharge driving signal includes the first slight-vibration waveforms P1, the driving element 111 is consecutively driven a plurality of times while the first displacement amount is maintained, thus vibrating the meniscus M of ink. This inhibits the meniscus M of ink from drying. However, the vortex flow is generated in the vicinity of the nozzle 11*a* in this situation. The vortex flow causes part of the components of ink to agglutinate or coagulate at the position above the opening of the nozzle 11*a*. In view of the above, in the non-discharge driving signal of this embodiment, at least one second slight-vibration waveform P2 follows after the first slight-vibration waveforms P1. That is, after the driving element 111 is consecutively driven a plurality of times while the first displacement amount is maintained, the driving element 111 is driven to be displaced by the second displacement amount larger than the first displacement amount. The largest displacement amount of the meniscus M of ink when the driving element 111 is driven to be displaced by the second displacement amount is larger than that when the driving element 111 is driven to be displaced by the first displacement amount. It is thus possible to redisperse part of the components of ink agglutinated at the position above the opening of the nozzle 11*a*. As a result, the ratio of components in the ink discharged is substantially equal between the timing after ink discharge is started and the timing after a few ink droplets are discharged, thus obtaining desired printing quality.

Figure 10A:
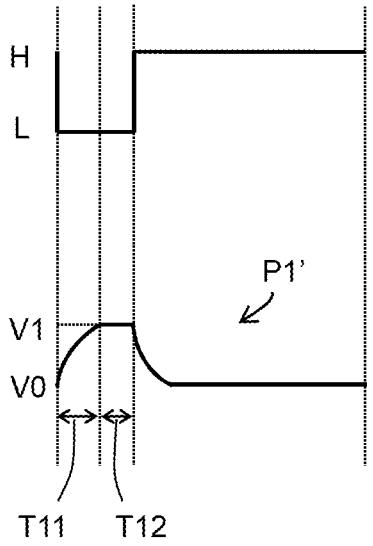
FIGS. 10A and 10B depict modifications of the first slight-vibration waveform.
Figure 10B:
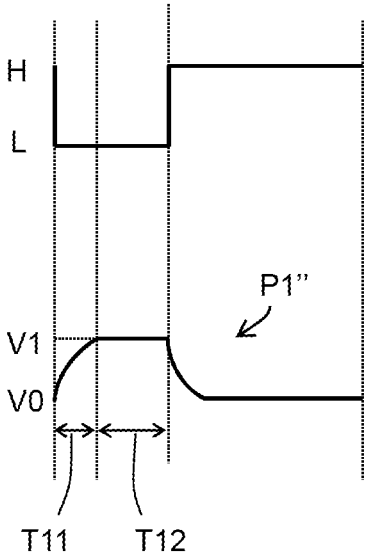

Subsequently, modified examples of the above embodiment are explained. In the above embodiment, the first slight-vibration waveform P1 starts to fall after reaching the voltage V1, and the second slight-vibration waveform P2 starts to fall after reaching the voltage V2. However, the timing at which the first slight-vibration waveform P1 starts to fall and the timing at which the second slight-vibration waveform P2 starts to fall are not limited thereto. For example, as depicted in FIGS. 10A and 10B, first slight-vibration waveforms P' and P" may take a time T11 to rise from the voltage V0 to the voltage V1, maintain the voltage V1 for a time T12, and then fall to the voltage V0. In this case, it is only required that a time T11+T12 obtained by adding the time T11 and the time T12 is shorter than a response time of the driving element 111 (i.e., a time required for displacing the driving element 111 to be displaced by the third displacement amount; for example, approximately 1.0 μs). The time T12 during which the voltage V1 is maintained may be shorter than the rising time T11 as depicted in FIG. 10A, or longer than the rising time T11 as depicted in FIG. 10B. The second slight-vibration waveform P2 may be deformed similarly to the first slight-vibration waveform P1.

The controller 7 may change, depending on characteristics of ink to be discharged, the number of non-discharge driving signals to be input to the driving element 111 from the driving signal generation circuit 30 within a certain time. For example, there may be a case where a plurality of kinds of inks need to have the same temperature within a predefined time before printing is started. In this case, the number of non-discharge driving signals (e.g., a waveform formed by four first slight-vibration waveforms P1 and four second slight-vibration waveforms P2 depicted at the lower side of FIG. 9) to be input to each driving element 111 of the head 11 included in the line head 4 from which ink having high specific heat is discharged may be larger than that of the head 11 included in the line head 4 from which ink having low specific heat is discharged. Or, there may be a case where it is required to inhibit meniscuses M of inks from drying in the line heads 4 from which a plurality of kinds of inks are discharged within a certain time before printing is started. In this case, the number of non-discharge driving signals to be input to each driving element 111 of the head 11 belonging to the line head 4 from which ink containing a solvent that easily evaporates is discharged, may be larger than that of the head 11 belonging to the line head 4 from which ink containing a solvent that is not likely to evaporate is discharged. The certain time, which corresponds to a discharge cycle, is from several microseconds to several tens of microseconds.

In the above embodiment, the non-discharge driving signal is input to the driving element 111 mainly before printing is started. However, the non-discharge driving signal may be input to the driving element 111 during a period during which no ink is discharged from the nozzle 11*a*. In this case, it is possible to inhibit the meniscus M of ink from drying while inhibiting the temperature of ink in the individual channel 12 from decreasing during the period during which no ink is discharged. Further, it is possible to inhibit the local change in the dispersing state of ink components.

In the above embodiment, the printing apparatus 1 performs printing on the sheet S in accordance with a line head system in which ink is discharged from each line head 4 that is fixed to the printing apparatus 1 and that is long in the sheet width direction. However, the printing apparatus 1 may perform printing on the sheet S in accordance with a serial head system in which a carriage moves the head 11 in the sheet width direction.

In the above embodiment, the sheet S is conveyed with the line heads 4 being fixed to the printing apparatus 1. The present disclosure, however, is not limited thereto. It is only required that the sheet S moves relative to the line heads 4. For example, the line heads 4 may be configured to move relative to the fixed sheet S.

What is claimed is:

1. A liquid discharge head, comprising:

a channel substrate having a nozzle and a channel communicating with the nozzle;

a driving element arranged on the channel substrate;

a driving signal generating circuit configured to generate a driving signal by which the driving element is driven; and a controller, wherein the driving signal includes a non-discharge driving signal by which the driving element is driven so that liquid in the channel is not discharged from the nozzle, the non-discharge driving signal includes at least one first slight-vibration waveform and at least one second slight-vibration waveform, the first slight-vibration waveform is a waveform by which the driving element is displaced by a first displacement amount, the second slight-vibration waveform is a waveform by which the driving element is displaced by a second displacement amount that is larger than the first displacement amount, and the at least one second slight-vibration waveform follows after the at least one first slight-vibration waveform, wherein the controller is configured to output first signal for generating the first slight-vibration waveform, second signal for generating the first slight-vibration waveform, and third signal for generating the second slight-vibration waveform to the driving signal generating circuit, wherein the first signal corresponding to the first slight-vibration waveform and the second signal corresponding to the first slight-vibration waveform are consecutive, wherein the second signal corresponding to the first slight-vibration waveform and the third signal corresponding to the second slight-vibration waveform are consecutive, and wherein a time interval between a start point of the first signal corresponding to the first slight-vibration waveform and a start point of the second signal corresponding to the first slight-vibration waveform is equal to a time interval between a start point of the second signal corresponding to the first slight-vibration waveform and a start point of the third signal corresponding to the second slight-vibration waveform.

2. The liquid discharge head according to claim 1, wherein the driving signal includes a discharge driving signal by which the driving element is driven so that the liquid in the channel is discharged from the nozzle, the discharge driving signal includes at least one discharge waveform, the discharge waveform is a waveform in which voltage changes from a first voltage to a second voltage higher than the first voltage and then changes from the second voltage to the first voltage, thereby displacing the driving element by a third displacement amount larger than the second displacement amount, and in each of the first slight-vibration waveform and the second slight-vibration waveform, voltage starts to change from the first voltage toward the second voltage, and then starts to change toward the first voltage before reaching the second voltage.

3. The liquid discharge head according to any one of claim 1, wherein the at least one first slight-vibration waveform includes a plurality of first slight-vibration waveforms, the non-discharge driving signal includes the plurality of first slight-vibration waveforms and the at least one second slight-vibration waveform, the plurality of first slight-vibration waveforms are consecutive waveforms, and the at least one second slight-vibration waveform is not included between the plurality of first slight-vibration waveforms.

4. The liquid discharge head according to claim 3, wherein the at least one second slight-vibration waveform includes a plurality of second slight-vibration waveforms, the non-discharge driving signal includes the plurality of first slight-vibration waveforms and the plurality of second slight-vibration waveforms, the plurality of second slight-vibration waveforms are consecutive waveforms, and the at least one first slight-vibration waveform is not included between the plurality of second slight-vibration waveforms.

5. A liquid discharge head, comprising, a channel substrate having a nozzle and a channel communication with the nozzle;

a driving element arranged on the channel substrate, and a driving signal generating circuit configured to generate a driving signal by which the driving element is driven, the driving signal includes a non-discharge driving signal by which the driving element is driven so that liquid in the channel is not discharged from the nozzle, the non-discharge driving signal includes at least on first slight-vibration waveform and at least one second slight-vibration waveform, the first slight-vibration waveform is a waveform by which the driving element is displaced by a first displacement amount, the second slight-vibration waveform is a waveform by which the driving element is displaced by a second displacement amount that is larger than the first displacement amount, the at least on second slight-vibration waveform follows after the at least one first slight-vibration waveform, the driving signal includes a discharge driving signal by which the driving element is driven so that the liquid in the channel is discharged from the nozzle, the discharge driving signal includes at least one discharge waveform, the discharge waveform is a waveform in which voltage changes from a first voltage to a second voltage higher than the first voltage and then changes from the second voltage to the first voltage, thereby displacing the driving element by a third displacement amount larger than the second displacement amount, in each of the first slight-vibration waveform and the second slight-vibration waveform, voltage starts to change from the first voltage toward the second voltage, and the starts to change toward the first voltage before reaching the second voltage, in the first slight-vibration waveform, voltage changes from the first voltage to a third voltage that is larger than the first voltage and smaller than the second voltage, is maintained at the third voltage, and changes from the third voltage to the first voltage, in the second slight-vibration waveform, voltage changes from the first voltage to a fourth voltage that is larger than the third voltage and smaller than the second voltage, is maintained at the fourth voltage, and changes from the fourth voltage to the first voltage, in the first slight-vibration waveform, a time during which the third voltage is maintained is shorter than a time required to change voltage from the first voltage to the third voltage, and in the second slight-vibration waveform, a time during which the fourth voltage is maintained is shorter than a time required to change voltage from the first voltage to the fourth voltage.

6. A liquid discharge head comprising:

a channel substrate having a nozzle and a channel communicating with the nozzle;

a driving element arranged on the channel substrate; and a driving signal generating circuit configured to generate a driving signal by which the driving element is driven, wherein the driving signal includes a non-discharge driving signal by which the driving element is driven so that liquid in the channel is not discharged from the nozzle, the non-discharge driving signal includes at least one first slight-vibration waveform an at least one second slight-vibration waveform, the first slight-vibration waveform is a waveform by which the driving element is displaced by a first displacement amount, the second slight-vibration waveform is a waveform by which the driving element is displaced by a second displacement amount that is larger than the first displacement amount, and the at least one second slight-vibration waveform follows after the at least one first slight-vibration waveform, wherein the driving signal includes a discharge driving signal by which the driving element is driven so that the liquid in the channel is discharged from the nozzle, the discharge driving signal includes at least one discharge waveform, the discharge waveform is a waveform in which voltage changes from a first voltage to a second voltage higher than the first voltage and then changes from the second voltage to the first voltage, thereby displacing the driving element by a third displacement amount larger than the second displacement amount, and in each of the first slight-vibration waveform and the second slight-vibration waveform, voltage starts to change from the first voltage toward the second voltage, and then starts to change toward the first voltage before reaching the second voltage, and wherein in the first slight-vibration waveform, voltage changes from the first voltage to a third voltage that is larger than the first voltage and smaller than the second voltage, is maintained at the third voltage, and changes from the third voltage to the first voltage, in the second slight-vibration waveform, voltage changes from the first voltage to a fourth voltage that is larger than the third voltage and smaller than the second voltage, is maintained at the fourth voltage, and changes from the fourth voltage to the first voltage, in the first slight-vibration waveform, a time during which the third voltage is maintained is longer than a time required to change voltage from the first voltage to the third voltage and is shorter than a time required to displace the driving element by the third displacement amount, and in the second slight-vibration waveform, a time during which the fourth voltage is maintained is longer than a time required to change voltage from the first voltage to the fourth voltage and is shorter than the time required to displace the driving element by the third displacement amount.

* * * * *